United States Patent [19]

Brinckman et al.

[11] Patent Number: 4,618,410

[45] Date of Patent: Oct. 21, 1986

[54] SHALE OIL DEARSENATION PROCESS

[75] Inventors: Frederick E. Brinckman, Derwood, Md.; Thomas F. Degnan, Jr., Yardley, Pa.; Carl S. Weiss, Racine, Wis.

[73] Assignee: The United States of America as represented by the Secretary of Commerce, Washington, D.C.

[21] Appl. No.: 794,590

[22] Filed: Nov. 4, 1985

Related U.S. Application Data

[63] Continuation of Ser. No. 665,875, Oct. 29, 1984, abandoned.

[51] Int. Cl.[4] ..... C10G 55/04

[52] U.S. Cl. ..... 208/97; 208/127; 208/131; 208/251 R

[58] Field of Search ..... 208/251 R, 11 R, 97, 208/50, 85, 127, 131

[56] References Cited

U.S. PATENT DOCUMENTS

| | | | |
|---|---|---|---|
| 2,779,715 | 1/1957 | Murray et al. | 208/88 |
| 4,142,961 | 3/1979 | Jensen | 208/97 |
| 4,181,596 | 1/1980 | Jensen | 208/251 R |
| 4,203,830 | 5/1980 | Rollman et al. | 208/251 R |
| 4,404,091 | 9/1983 | Rankel | 208/251 R |
| 4,439,313 | 3/1984 | Schindler et al. | 44/4 |
| 4,454,027 | 6/1984 | Fenton | 208/253 |
| 4,473,461 | 9/1984 | Thacker et al. | 208/251 R |

*Primary Examiner*—Andrew H. Metz
*Assistant Examiner*—Anthony McFarlane
*Attorney, Agent, or Firm*—Eugene J. Pawlikowski; Alvin J. Englert; Charles R. Wolfe, Jr.

[57] ABSTRACT

An improved process for shale oil dearsenation comprises coking a retorted shale oil stream following by contacting the liquid coker product with water. Water washing is preferably carried out under ambient conditions to achieve a reduction to less than 3 ppm w soluble arsenic.

6 Claims, No Drawings

SHALE OIL DEARSENATION PROCESS

BACKGROUND OF THE INVENTION

This application is a continuation of application Ser. No. 665,875, filed Oct. 29, 1984, now abandoned.

This invention relates to processing shale oil and in particular to processing shale oil to reduce the arsenic content. Specifically, the invention relates to treating shale oil by a combination of processes—coking and water washing.

Many shale oils produced by conventional retorting processes contain inorganic materials, such as arsenic, which interfere with subsequent refining or catalytic hydroprocessing operations. Examples of these hydroprocessing operations are hydrogenation, denitrogenation, and desulfurization. From an environmental standpoint, removal of such contaminants may be desirable even if the shale oil is to be used directly as a fuel. Hence, it is desirable that contaminants such as arsenic be removed, or reduced to low levels, prior to further processing of the shale oil or prior to its use as a fuel.

Previous methods for removing arsenic from hydrocarbon oils include contacting raw shale oil with a dearsenation catalyst, such as those containing oxides or sulfides of nickel, cobalt, or iron. This catalytic dearsenation is normally carried out at an elevated temperature and usually in the presence of hydrogen under pressure. Examples can be found in U.S. Pat. Nos. 3,876,533; 3,933,624; 3,954,603; 4,003,829; 4,046,674; and 4,051,022.

It has also been recognized in U.S. Pat. No. 4,029,571 that arsenic can be removed from shale oil by heat soaking or visbreaking the oil long enough to form a suspended precipitate which must be subsequently mechanically separated from the oil. The oil may also be visbroken and a portion of the visbroken oil catalytically hydrogenated.

Other methods for treating shale oils include visbreaking the oil, solvent deasphalting the visbroken oil, and contacting the resulting visbroken, deasphalted oil with hydrogen in the presence of a catalyst, as described in U.S. Pat. No. 3,132,088. In U.S. Pat. No. 2,975,121 there is described a process for removing metals from an asphaltic oil in which the oil is heat-soaked with hydrogen to form a metals-containing precipitate in the oil, and metals-containing oil is solvent deasphalted to remove metals in the asphaltene fraction. U.S. Pat. No. 4,188,280, describes a method for removing arsenic from shale oil by a combination of thermal dearsenation, coking and catalytic hydroprocessing.

It has been suggested by Curtin et al in Arsenic and Nitrogen Removal During Shale Oil Upgrading, ACS Div., Fuel Chem. No. 23 (4), Sept. 10–15, 1978, to treat raw shale oil by coking it follow by catalytic hydrodenitrogenation of coker distillate or a blend of raw shale oil and coker distillate.

SUMMARY OF THE INVENTION

This invention is a combination process for removing arsenic from shale oil. A shale oil containing more than 4, and preferably more than 8, ppmw soluble arsenic is first coked to remove a portion of the arsenic from the oil. The coker distillate is then contacted with water in order to further remove arsenic. The hydrogen product from the water treatment or washing step contains less than 3 ppmw arsenic.

In accordance with an embodiment of the present invention, there is provided a method for producing a dearsenated shale oil product from a shale oil feedstock contaminated with more than 4 ppmw arsenic in the form of at least one soluble arsenic compound which comprises: (a) forming a coker distillate having an arsenic content lower than that of the raw shale oil and an arsenic containing coke by coking at least a portion of the raw shale oil; and (b) producing a shale oil product having less than 3 ppmw soluble arsenic by contacting the coker distillate with water.

DETAILED DESCRIPTION OF THE INVENTION

The feedstock for the present invention consists of a shale oil which contains soluble arsenic in amounts greater than 4 ppm, by weight, preferably above 8 ppm, by weight, and more preferably from 20 to 100 ppm or more, by weight. The shale oil will also frequently contain at least 10 ppmw soluble iron, and more typically from 30 to 500 ppm or more, by weight. The levels of arsenic and iron contaminants in a given shale oil will, of course, depend upon the origin of the oil and upon the particular retorting process and conditions used to remove it from the shale. "Soluble arsenic" includes compounds and ions of arsenic which are soluble in the feedstock. "Soluble iron" includes compounds and ions of iron which are soluble in the feedstock. The raw shale oil feedstock may be a whole shale oil or a fraction thereof.

The coking step involves heating an oil to a temperature ranging from 399° to 1093° C. (750° to 2000° F.) at a pressure of atmospheric or above. Preferred pressures are from atmospheric to 5 atm gauge. Coking is a well known thermal cracking process for converting an oil into distillate and coke. Any suitable coking method, for example, delayed coking or fluid coking, may be used in the method of the present invention. All or part of the raw shale oil may be coked or the raw shale oil can be fractionated and just the heavier portion of the oil coked.

The coking step will further reduce the amount of soluble arsenic in the shale oil, often by as much as $\frac{1}{2}$ to $\frac{1}{3}$ of the arsenic in the raw shale oil.

In the water treatment step, the coking shale oil is contacted with water at atmospheric pressure and preferably at ambient temperature. The water treatment step removes the polar arsenic compounds present in the coker distillate. Because the polar arsenicals are typically acidic, it is preferred that the pH of the water be equal to or greater than 7. Preferably, one or more of the iron or water soluble nitrogen contaminants will also be removed from, or reduced in concentration in the oil during the water treatment step.

The water treatment can be carried out by any means that is effective in intimately mixing oil and water. The water washing is preferably carried out under ambient conditions, i.e., 70° F., 1 atm. A preferred method would comprise adding oil and water to a process vessel and agitating the mixture with a highspeed stirring device. An alternative is to use a desalting apparatus that is conventionally employed in the petroleum industry in pretreating hydrocarbon feeds that have come into contact with brine.

The oil to water ratio used for the water treatment step should be in the range of 0.001 to 1.0. For practical purposes, it is desirable to use as little water as is possible in order to concentrate the water soluble arsenicals for subsequent use or disposal. Separation of the oil from the water can be effected by any of a number of means including settling and decanting by phase separation or distillation.

EXAMPLES

In order to more fully illustrate the method of the present invention, the following specific examples are presented. These examples are in no sense intended to limit the present invention.

EXAMPLE 1

A raw Paraho shale oil with the properties shown in Table 1 was delay coked by passing the 450° C. boiling point fraction of the raw shale oil upwards through a vertical tube that was maintained at an inlet temperature of 510° C. and an outlet temperature of 482° C. Residence time in the tube was twenty-four hours at 241 k Pa. The >454° C. fraction comprised the heaviest 40 wt. % of the whole shale oil and contained 51 wt. % of the arsenic present in the whole shale oil. The arsenic concentration in the coker distillate was 4.2 ppm compared with an arsenic concentration of 28 ppm in the charge. Arsenic concentration was measured by graphite furnace atomic absorption using a Perkin-Elmer Model 460 GFAA spectrophotometer.

EXAMPLE 2

The product from Example 1 was mixed with distilled, deionized water (18M Ω-cm) in a 1:1 wt:wt proportion in a 10 cc vial. This vial was then placed in an ambient temperature sonication bath for one hour in order to provide intimate mixing between the oil and water phases. Maximum power to the 1.0 liter bath was 100 watts at 20 kHz. The mixture was subsequently centrifuged and water and oil were drawn off separately for analysis. The water contained 2.0 ppm arsenic while the oil contained 2.2 ppm water-insoluble arsenic as determined by GFAA.

EXAMPLE 3

The raw shale oil whose properties are shown in Table 1 was mixed with distilled, deiozided water in a 1:1 wt:wt proportion and sonicated in an identical manner to that described in Example 2. Following removal of the water from the oil by centrifugation, the water treatment step was repeated a second time. The twice water-washed oil was analyzed and found to contain 16.9 ppm arsenic.

EXAMPLE 4

The same raw shale oil used in Examples 1 and 3 was treated with a caustic solution by contacting 500 ml of the oil successively with 500 ml of a 2.0N NaOH solution and 500 ml of a 0.5N NaOH solution. In both washings, the oil and caustic mixtures were shaken vigorously for twelve hours using a Junior Orbit Shaker (Lab-Line Inc., Melrose Park, IL) set at 300 rpm. The water was removed from the oil by decanting after allowing the mixture to settle for twelve hours. Arsenic level of the isolated oil was 8.3 ppm by GFAA analysis.

EXAMPLE 5

The caustic washed shale oil product from Example 4 was mixed with distilled, deionized water and placed in a sonification bath according to the procedure described in Example 2. Following centrifugation, the water was decanted off and the oil was analyzed for arsenic content. Arsenic in the oil following two caustic treatments and one water wash was 6.8 ppm.

The results are summarized in Table 2 which compares the relative dearsenation efficiencies of the various processes. This comparison clearly shows the superiority of the two-step delayed coking-water washing process for arsenic removal.

TABLE 1

CHARACTERISTICS OF SHALE OIL SAMPLES USED IN THIS STUDY

| | | WATER WASHED | COKED PSO | | $\gamma$-$Al_2O_3$ Guard Bed | NiW Guard Bed |
|---|---|---|---|---|---|---|
| | WHOLE PSO | PSO | Liquid | Coke | Dearsenated | Dearsenated |
| Arsenic, ppm - GFAA | 21.9 | 16.9 | 4.2 | 60.1 | 16.1 | 2.4 |
| Hydrogen % - NMR | 11.48 | 11.5 | 11.82 | 7.8 | 11.72 | 11.77 |
| Oxygen, % - Micro Pregel | 1.9 | 1.9 | 4.6 | | 1.5 | 1.2 |
| Nitrogen, % Micro Dumas | 2.13 | 1.03 | 2.16 | 2.45 | 2.03 | 2.07 |
| Basic Nitrogen, ppm | 13500.0 | 10300.0 | 1.65 | | 12800.0 | 1.3 |
| API Gravity, ASTM D1298-3 | 19.7 | 19.7 | 26.2 | | 28.7 | 27.9 |
| Carbon Residue (Conradson) | 3.13 | 3.1 | 2.35 | | 1.32 | 1.09 |
| Asphaltenes, % | 1.39 | 1.40 | 0 | | | |
| Metals, ppm | | | | | | |
| Nickel | 3.3 | 3.0 | 0 | 56.0 | 0.28 | 2.4 |
| Vanadium | 0.32 | 0.4 | 0 | 4.9 | 0.01 | 0.8 |
| Iron | 38.0 | 30.0 | 0.5 | 562.0 | 2.1 | 7.0 |
| Copper | 0.18 | 0.1 | 0.22 | | 0.5 | |
| Sodium | 35.0 | 2.0 | 0 | | 0.28 | 1.27 |
| Distillation (¼F) | | | | | | |
| .5% OFF | 465.0 | 450.0 | 31.6 | | 176.0 | 289.0 |
| 5% OFF | 589.0 | 590.0 | 163.0 | | 299.0 | 417.0 |
| 10% | 650.7 | 648.4 | 242.0 | | 352.0 | 465.0 |
| 20% | 719.8 | 714.3 | 338.0 | | 429.0 | 546.0 |
| 30% | 762.6 | 758.5 | 434.0 | | 482.0 | 611.0 |
| 40% | 797.1 | 792.6 | 513.0 | | 530.0 | 687.0 |
| 50% | 823.6 | 819.1 | 583.0 | | 583.0 | 742.0 |
| 60% | 848.0 | 843.0 | 652.0 | | 636.0 | 796.0 |
| 70% | 874.7 | 870.7 | 729.0 | | 703.0 | 878.0 |
| 80% | 909.9 | 901.1 | 796.0 | | 786.0 | 922.0 |
| 90% | 942.9 | 938.7 | 860.0 | | 883.0 | 977.0 |
| 95% | 976.5 | 974.3 | 906.9 | | 954.0 | 993.0 |

TABLE 1-continued

| | CHARACTERISTICS OF SHALE OIL SAMPLES USED IN THIS STUDY | | | | | |
|---|---|---|---|---|---|---|
| | | WATER WASHED | COKED PSO | | $\gamma$-$Al_2O_3$ Guard Bed | NiW Guard Bed |
| | WHOLE PSO | PSO | Liquid | Coke | Dearsenated | Dearsenated |
| 99.5% | 1074.0 | 1078.0 | 1011.0 | | 1116.0 | 1023.0 |

TABLE 2

| SUMMARY OF DEARSENATION EFFICIENCIES OF VARIOUS PROCESSES | | | | | |
|---|---|---|---|---|---|
| Process | Arsenic Level In Product Prior to $H_2O$ Wash (ppm) | Dearsenation Efficiency of Prewash Step (%) | Arsenic Level in Product After Wash (ppm) | Dearsenation Efficiency of Water Wash (%) | Overall Dearsenation Efficiency |
| Caustic washing | 8.33 | 67.4 | 6.81 | 18.2 | 75.7 |
| Water washing (2×) | 21.90 | 21.8 | 16.91 | 22.8 | 39.6 |
| No treatment | — | — | 18.50 | 1.7 | 1.7 |
| Delayed coking | 4.20 | 85.0 | 2.18 | 48.1 | 92.2 |

While the present invention has been described in terms of certain preferred embodiments, and exemplified with respect thereto, one skilled in the art will readily appreciate that various modifications, change, omissions, and substitutions may be made without departing from the spirit thereof. It is intended, therefore, that the present invention be limited solely by the scope of the following claims.

We claim:

1. A method for producing a dearsenated shale oil product from a shale oil feedstock contaminated with more than 4 ppmw arsenic in the form of at least one soluble arsenic comprising:

(a) forming a coker distillate having an arsenic content lower than that of the shale oil feedstock by coking at least a portion of said feedstock at a temperature between 750° and 2000° F.;

(b) contacting said coker distillate with water; and (c) separating said water from said coker distillate to produce a shale oil product having less than 3 ppmw soluble arsenic.

2. The method of claim 1, wherein said coker distillate is contacted with said water at ambient temperature and pressure.

3. The method of claim 1, wherein the oil to water ratio in step (b) is in the range of 0.001 to 1.0.

4. The method of claim 1, wherein said coker distillate is produced by delayed coking.

5. The method of claim 1, wherein said coker distillate is produced by fluid coking.

6. The method of claim 1, wherein said coker distillate is produced from the heavier portion of raw shale oil which has been fractionated.

* * * * *